US005329872A

United States Patent [19]

Wright

[11] Patent Number: 5,329,872

[45] Date of Patent: Jul. 19, 1994

[54] ALL WEATHER SAFETY WHISTLE AND SOUND GENERATOR

[76] Inventor: Howard W. Wright, 4920 Crownover, St. Louis, Mo. 63128

[21] Appl. No.: 753,317

[22] Filed: Aug. 30, 1991

[51] Int. Cl.[5] ..... G10K 5/00

[52] U.S. Cl. ..... 116/137 R; 116/140; 84/380 C; 446/204

[58] Field of Search ..... 116/137 R, 24, 140, 116/DIG. 7, DIG. 18, DIG. 19; 84/330, 380 R, 380 C, 386, 384; 446/202, 204, 205, 206, 209, 216; D10/119; D21/64

[56] References Cited

U.S. PATENT DOCUMENTS

| | | | |
|---|---|---|---|
| 33,437 | 10/1861 | Lamb . | |
| 189,587 | 4/1877 | Thompson | 116/137 R |
| D. 311,350 | 10/1990 | Tsuji | D10/119 |
| 842,327 | 1/1907 | Mundy et al. . | |
| 1,113,400 | 10/1914 | Baumgartner . | |
| 1,463,507 | 7/1923 | Hahnemann . | |
| 1,626,198 | 4/1927 | Jacquemin | 116/137 R |
| 1,688,349 | 10/1928 | Petrie . | |
| 1,795,213 | 3/1931 | Jordahn | 446/204 X |
| 1,867,903 | 7/1932 | Wilcox | 446/205 |
| 1,926,688 | 9/1933 | Schaal | 116/137 R |
| 2,053,982 | 9/1936 | Weiss | 116/DIG. 18 X |
| 2,113,396 | 4/1938 | Butterfield | 116/137 R |
| 2,238,668 | 4/1941 | Wellenstein | 116/137 |
| 2,454,105 | 6/1946 | Thompson . | |
| 2,927,399 | 3/1960 | Bacon . | |
| 3,376,949 | 4/1968 | Baker et al. | 181/0.5 |
| 3,536,157 | 10/1970 | Anstey | 181/0.5 |
| 3,548,538 | 12/1970 | Christoffel et al. | 46/178 |
| 3,745,871 | 7/1973 | Diez | 84/380 X |
| 3,824,949 | 7/1974 | Aquila | 116/137 R |
| 5,002,006 | 3/1991 | Ehrenreich | 116/137 R |

FOREIGN PATENT DOCUMENTS

| | | | |
|---|---|---|---|
| 0212456 | 1/1958 | Australia | 84/380 |
| 1309168 | 12/1962 | France | 116/137 R |
| 2218298 | 8/1989 | United Kingdom . | |

*Primary Examiner*—William A. Cuchlinski, Jr.
*Assistant Examiner*—John L. Beres
*Attorney, Agent, or Firm*—Armstrong, Teasdale, Schlafly & Davis

[57] ABSTRACT

An all weather safety whistle and sound generator is provided having a mouthpiece and a sound producing opening for emitting sound when air is blown into the mouthpiece, and having a cowling structure covering over the sound producing opening protecting the opening from substances exterior to the apparatus while simultaneously enabling the opening to produce sound.

3 Claims, 2 Drawing Sheets

FIG. 1.
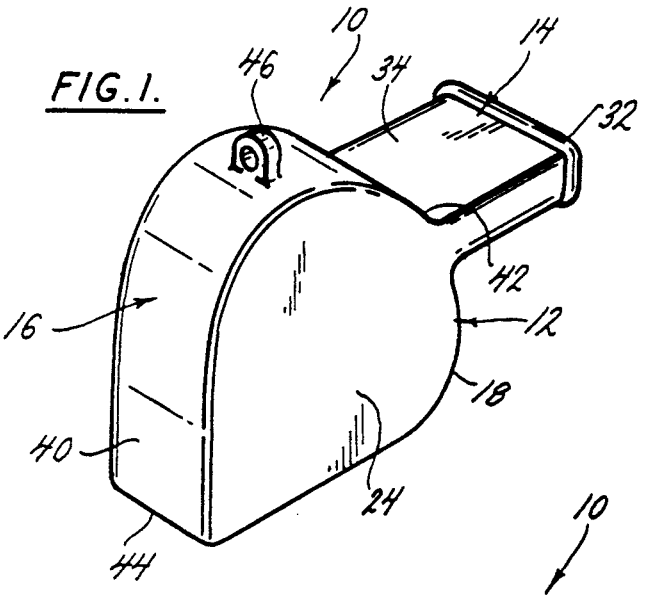
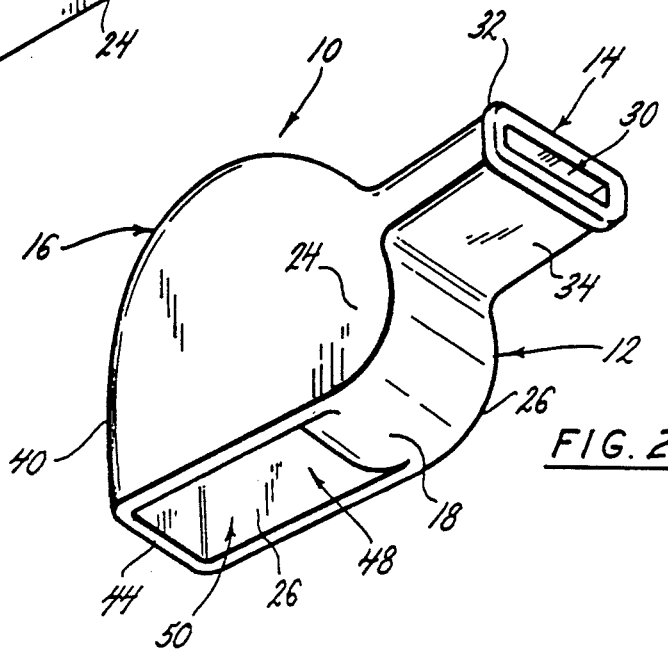
FIG. 2.
FIG. 3.
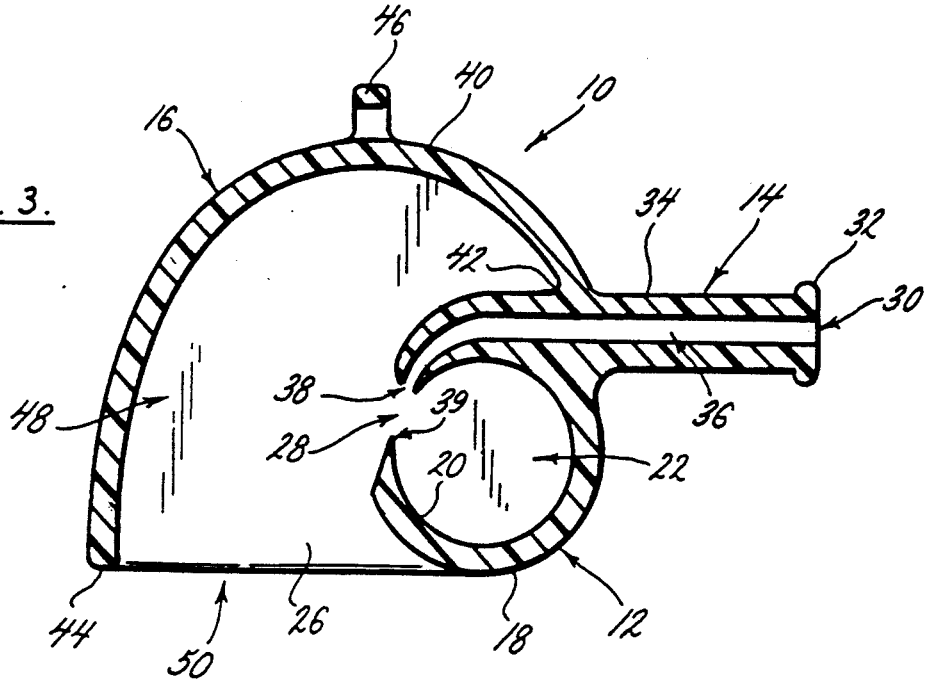

ALL WEATHER SAFETY WHISTLE AND SOUND GENERATOR

BACKGROUND OF THE INVENTION (1) Field of the Invention

The present invention relates to a safety whistle and sound generator that is capable of producing sound in various different environments and weather conditions. In particular, the all weather safety whistle and sound generator of the present invention is specifically designed to produce sound in rainy weather conditions or high winds and waves, and is also designed to produce sound when submerged under water.

(2) Description of the Related Art

Prior art whistles that produce sound by an operator blowing air through the whistle are typically comprised of a body portion having a sound producing chamber contained therein, and a mouthpiece connected to the body portion and communicating with the internal chamber. The body portion is provided with a sound producing opening that communicates the internal chamber with the exterior of the whistle. The whistle produces sound by the operator blowing air through the mouthpiece into the chamber, with the sound produced in the chamber exiting through the sound producing opening.

Prior art whistles of this type are disadvantaged in that the sound producing openings of the whistles are exposed to the environment when the whistle is in use. Should the whistle be used in rainy conditions or high winds, the rain or wind entering the sound producing opening of the whistle will have a detrimental effect on the sound produced by the whistle. In bad weather conditions, prior art whistles may be prevented from producing any sound.

The above described disadvantage of prior art whistles may be encountered in the whistles provided on the life vests of ship passengers. Should a ship passenger need to abandon ship, a whistle provided with the life vest is used to signal their position in the water to other passengers in the water nearby or to rescue vessels. If water should enter the sound producing opening of the whistle from waves washing over the passenger's head, the water could detrimentally effect the ability of the whistle to produce sound.

What is needed in both the situations described above to overcome the disadvantages often encountered in prior art whistles is an improved all weather safety whistle and sound generator that is capable of producing sound in rainy or wet conditions.

SUMMARY OF THE INVENTION

The all weather safety whistle and sound generator of the present invention is generally comprised of a body portion, a mouthpiece, and a cowling. The body portion, mouthpiece and cowling are formed integrally with each other and may be inexpensively manufactured from plastics or other materials. The all weather safety whistle and sound generator of the invention has a compact construction that enables the whistle to be easily carried on a cord or chain or in the pocket of the user.

The body portion of the all weather safety whistle and sound generator is similar to that of conventional whistles in that it encloses a sound producing chamber. A sound emitting or producing opening is provided in the body portion communicating the interior chamber with the exterior of the body portion.

The mouthpiece of the apparatus of the invention is provided with an air inlet opening and an air flow channel extending through the mouthpiece. The air flow channel exits through an air flow outlet positioned adjacent the sound producing opening of the body portion and communicating with the interior chamber of the body portion. By the operator blowing air through the air flow chamber of the mouthpiece, the interior chamber and sound producing opening of the body portion generate and emit sound in much the same manner as conventional whistles.

The cowling of the apparatus of the invention is secured to the exterior of the mouthpiece and body portion. The cowling has a general semicircular configuration and extends over the sound producing opening of the apparatus. The cowling has an interior volume that communicates with the interior chamber of the body portion through the sound producing opening of the body portion. The sound produced by the body portion passes through the interior volume of the cowling and exits the apparatus of the invention through a cowling opening positioned below the sound producing opening of the body portion. The cowling interior has a generally horn shape that serves to amplify the whistle sound as it passes through the cowling as is typical in horn or cone shaped tubes. The structure of the cowling substantially surrounds the sound producing opening of the body portion on all sides of the opening. This shields the sound producing opening from rain, wind or water exterior to the apparatus and prevents rain, wind or water from entering the sound producing opening and effecting the apparatus' ability to produce sound.

In variant embodiments of the invention, a closure member is provided on the side of the body portion covering over an access opening to the interior chamber of the body portion. A first closure member is provided that is slip fit inside the access opening and reduces the internal volume of the interior chamber. By selectively inserting and removing the first closure member from the interior volume of the interior chamber, the sound produced by the apparatus of the invention is changed from a single tone whistle to a two tone whistle.

A second closure member covers over the access opening of the body portion without extending into the interior chamber of the body portion. This closure member is provided to selectively open and close the access opening, providing access to the interior chamber to insert or remove a pea into or from the interior chamber. The insertion or removal of the pea also varies the sound produced by the apparatus of the invention.

In a still further variant embodiment of the invention, the cowling is provided with a plurality of louvers. The louvers shield the sound producing opening of the apparatus from rain, wind or water exterior to the apparatus while enabling sound produced by the apparatus to pass between the louvers.

In a still further embodiment of the invention, the cowling is positioned relative to the body portion and the mouthpiece of the apparatus to project sound from the apparatus in substantially the same direction that the operator of the apparatus is facing. In this embodiment of the invention, the cowling also shields the sound producing opening from rain, wind or water exterior to the apparatus, preventing rain, wind or water from entering the sound producing opening.

BRIEF DESCRIPTION OF THE DRAWINGS

Further objects and features of the present invention are revealed in the following detailed description of the preferred embodiment of the invention and in the drawing figures wherein:

FIG. 1 is a perspective view of a first embodiment of the all weather safety whistle and sound generator of the present invention;

FIG. 2 is an additional perspective view of the embodiment of the invention shown in FIG. 1;

FIG. 3 is a side elevation view, in section, of the embodiment of the invention shown in FIG. 1;

DETAILED DESCRIPTION OF THE PREFERRED EMBODIMENT

Figure 4:
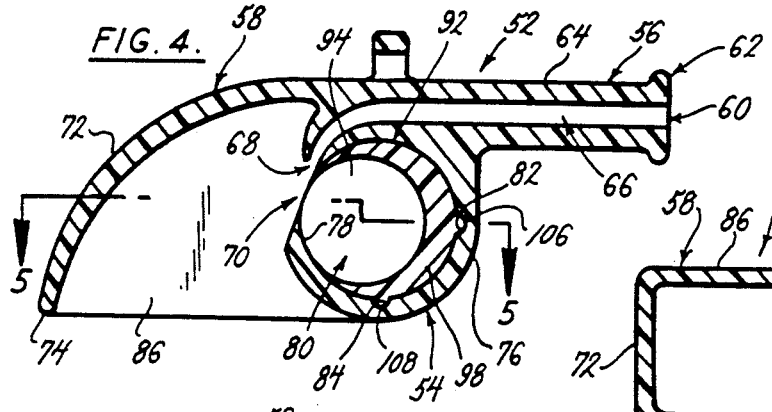
FIG. 4 is a side elevation view, in section, of a second embodiment of the invention employing a first closure member of the invention.

A first embodiment of the all weather safety whistle and sound generator 10 of the present invention is shown in drawing FIGS. 1–3. As seen in the drawing figures, the whistle 10 is generally comprised of a body portion 12, a mouthpiece 14, and a cowling 16. The body portion, mouthpiece and cowling are formed together as a single unit. The whistle may be constructed from plastic or other materials as desired. As can be seen from the drawing figures, the simplified structure of the whistle 10 enables it to be manufactured inexpensively, and also enables it to be constructed in a compact size. The compact size of the whistle enables it to be carried easily by a cord attached to the whistle or stored in a pocket of the whistles user.

In the preferred embodiment of the invention, the whistle body portion 12 has a general cylindrical configuration. However, the whistle can be constructed in different geometric shapes without significantly effecting the functioning of the whistle. As seen in the drawing figures, the body portion 12 has a general cylindrical exterior surface 18 and a general cylindrical interior surface 20 forming an interior chamber 22 of the whistle. The interior chamber 22 is the sound producing chamber of the whistle. Opposite end walls 24, 26 of the whistle body portion 12 cover over opposite ends of the whistle interior chamber 22. The volume of the interior chamber 22 is completely enclosed by the whistle body portion 12 except for an opening or orifice 28 extending through the body portion from the interior surface 20 to the exterior surface 18 of the body portion. The opening 28 is the sound producing opening of the whistle.

Although not shown in drawing FIGS. 1–3, a pea could be provided in the interior volume of the body portion chamber 22. As in conventional whistles, the pea would be provided to produce a warbling sound from the whistle.

The mouthpiece 14 has a general rectangular configuration that merges into the cylindrical configuration of the body portion 12. An air inlet opening 30 is provided at one end of the mouthpiece. A ridge 32 is provided on the exterior surface 34 of the mouthpiece surrounding the air inlet opening. The ridge facilitates gripping the mouthpiece between the teeth or lips of the whistle operator. An air flow channel 36 extends through the interior of the mouthpiece 14 from the air inlet opening 30 to an air flow outlet 38 positioned adjacent the sound producing opening 28 of the body portion. The air flow outlet 38 is positioned relative to the sound producing opening 28 and an edge 39 of the body portion adjacent the sound producing opening 28 to produce the desired whistle tone or generate the desired sound when an operator of the whistle blows air through the air inlet opening 30 of the mouthpiece. The sound is produced by the whistle in much the same manner as conventional whistles. As is best seen in FIG. 3, the mouthpiece 14 curves downward as it approaches the sound producing opening 28 of the body portion 12 and forms a portion of the cylindrical interior wall surface 20 of the body interior chamber 22.

The cowling 16 of the first embodiment of the invention shown in FIGS. 1–3 has a general semicircular shape, although the cowling may be provided in different shapes to best suit the particular configuration of the whistle body portion. The cowling 16 is formed with a top wall 40 that is formed unitarily with the exterior surface 34 of the mouthpiece 14 at one end 42, and curves from the mouthpiece over the sound producing opening 28 of the body portion 12 to a distal end 44. An eyelet 46 is formed on the exterior surface of the cowling top wall 40 for connection to a cord or chain (not shown). The opposite sides of the cowling 16 are formed by the opposite side walls 24, 26 of the body portion 12. As seen in the drawing figures, the body portion side walls 24, 26 extend back from the body portion 12 and mouthpiece 14 to the side edges of the cowling top wall 40 and are formed unitarily with these side edges. As is best seen in FIG. 3, the cowling, comprised of the top wall 40 and the opposite side walls 24, 26, completely covers over and encloses the air flow outlet 38 of the mouthpiece 14 and the sound producing opening 28 of the whistle body portion 12. The cowling 16 encloses a cowling interior volume 48 just outside the whistle sound producing opening 28 that enables sound generated by the whistle to escape through the sound producing opening 28 into the cowling interior 48 and to exit the cowling interior through a large sound emitting opening 50 provided at the bottom of the cowling 16.

As seen in FIG. 3, the cowling 16 completely covers over the sound producing opening 28 of the whistle body portion 12, while providing a sufficient volume 48 beneath the cowling to enable sound produced by the whistle to escape through the sound producing opening 28, pass through the cowling interior volume 48, and pass out from the whistle through the sound emitting opening 50 of the cowling. The general horn shape of the cowling interior 48 has a cross-sectional area that increases as it approaches the sound emitting opening 50 and serves to amplify the whistle sound as it passes through the cowling. The cowling 16 protects the sound producing opening 28 from water that could possibly enter the sound producing opening of a conventional whistle and prevent the whistle from generating sound. For example, the cowling 16 enables the whistle and sound generator of the present invention 10 to be used in rainy or windy conditions. Rain would not effect the operation of the apparatus of the invention because the cowling 16 covers over the sound producing opening 28 of the invention and prevents any rain from entering the opening.

The cowling 16 of the invention is also effective in preventing water from entering the interior chamber 22 of the invention when the apparatus of the invention is used under water in its upright orientation shown in FIG. 3. By submerging the apparatus under water with the mouthpiece 14 of the apparatus held in the mouth of an operator in the orientation shown in FIG. 3, an air bubble will remain under the cowling 16. The volume of air in the bubble will prevent water from rising up in the cowling interior 48 and entering the sound opening 28, and will enable the mouthpiece 14 and body portion 12 of the apparatus to still generate sound by the operator blowing through the mouthpiece of the apparatus. Even if water should enter the interior volume 48 of the cowling 16 as the apparatus is submerged, by the operator blowing air through the mouthpiece any water contained in the interior chamber 22 of the body portion and the interior volume 48 of the cowling will be purged from these volumes. Once the water is ejected from the interior volumes of the apparatus and the air bubble is recreated in the cowling interior by the operator blowing air through the apparatus, continued blowing through the mouthpiece will produce or generate sound under water.

FIGS. 4–7 show a further embodiment of the present invention. The all weather safety whistle and sound generator 52 of the invention shown in FIGS. 4–7 is substantially identical to that shown in FIGS. 1–3 in that they are comprised of a body portion 54, a mouthpiece 56 and a cowling 58.

As in the first embodiment of the invention, the mouthpiece 56 of the second embodiment includes an air inlet opening 60 and a ridge 62 on the exterior surface 64 of the mouthpiece surrounding the inlet opening. An air flow channel 66 extends through the mouthpiece 56 to an air flow outlet 68 positioned adjacent a sound producing opening 70 of the body portion 54.

The cowling 58 is comprised of a curved top wall 72 that is secured to the exterior surface of the mouthpiece 64 at one end and curves over the sound producing opening 70 to its distal end 74 in much the same manner as the cowling of the previously described embodiment of the invention.

The differences between the embodiment of the all weather safety whistle and sound generator 52 shown in FIGS. 4–7 from the embodiment shown in FIGS. 1–3 are primarily contained in the structure of the body portion 54. As in the first embodiment, the body portion has a general cylindrical configuration with an exterior surface 76 and a general cylindrical interior surface 78. The cylindrical interior surface 78 of the body portion defines the sound producing interior chamber 80 of this embodiment of the invention. Unlike the first embodiment of the invention, the cylindrical interior surface 78 of the body portion 54 is provided with a pair of grooves 82, 84 that are formed in the surface and extend half way across the interior chamber 80 of the body portion. As in the first embodiment of the invention, a continuous side wall 86 covers over one side of the cowling 58 and the interior chamber 80 of the body portion. However, an opposed side wall 88 covers over only the side of the cowling 58. An aperture or access opening 90 is left in the side wall 88 providing access to the interior chamber 80 of the body portion.

Two different closure members are provided with this embodiment of the invention for covering over the access opening 90 and enclosing the interior chamber 80 of the body portion, and thereby effecting the sound generating function of the invention. The first of these two closure members is shown in FIGS. 4 and 5.

Figure 5:
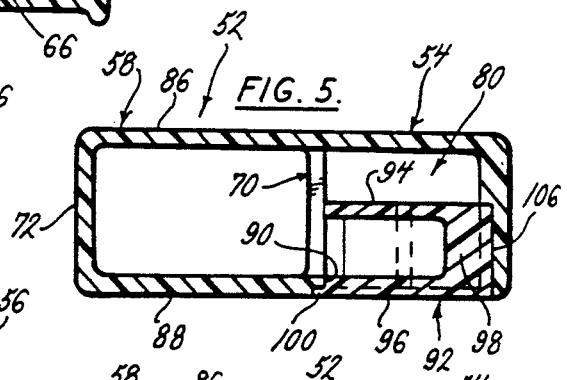
FIG. 5 is a plan view of the embodiment of the invention shown in FIG. 4 taken along the line 5—5 of FIG. 4.

The closure member 92 shown in FIGS. 4 and 5 is generally comprised of an interior wall 94, an exterior wall 96, and a connecting web extension member 98. The interior wall 94 is dimensioned to be slidably fit inside the interior chamber 80 of the body portion with the peripheral edge of the interior wall 94 engaging against the interior surface 78 of the chamber 80. The exterior wall 96 is dimensioned to provide a snug water tight fit inside the access opening 90 in the side wall of the apparatus, completely closing the access opening. The exterior wall 96 is provided with a lip 100 around its peripheral edge that overlaps a shoulder 102 formed in the apparatus side wall 88 and completely surrounding the access opening 90. The web extension member 98 has a general crescent configuration as is best seen in FIG. 4. An interior surface 104 of the web extension member 98 defines an interior volume of the first closure member 92. A pair of ridges 106, 108 are formed on the exterior surface of the web extension member 98. As seen in FIG. 4, the ridges 106, 108 are positioned on the exterior surface of the web extension member 98 to fit in sliding engagement in the pair of grooves 82, 84 formed in the interior surface 78 of the interior chamber 80.

The first closure member 92 is dimensioned to be slidably fit inside the interior chamber 80 of the apparatus 52 through the access opening 90 in the side wall 88 of the apparatus. Inserting the first closure member 92 into the interior chamber 80 reduces the internal volume of the chamber and alters the sound generated by the apparatus 52. By selectively inserting and removing the first closure member 92 into and out of the interior chamber 80 of the apparatus 52, the operator of the apparatus may change the sound produced by the apparatus 52 from a single tone whistle to a two tone whistle.

Figure 6:
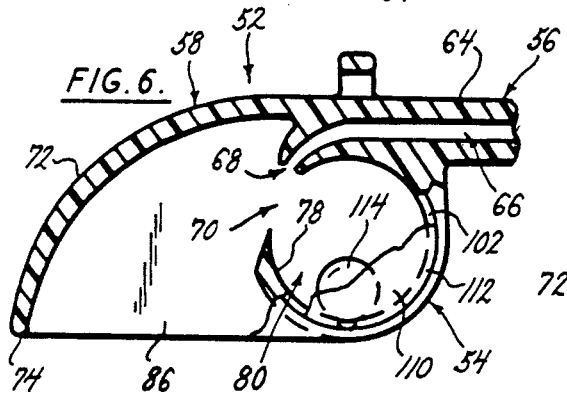
FIG. 6 is a partial elevation view, in section, of the second embodiment of the invention employing a second closure member.
Figure 7:
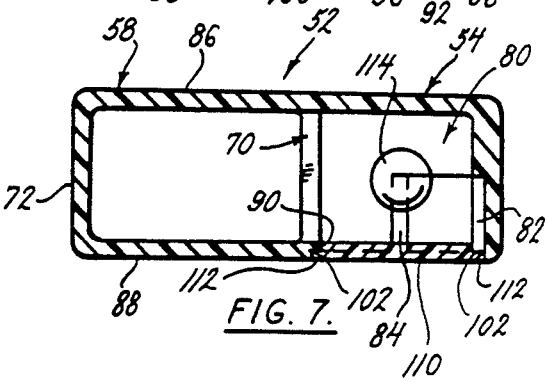
FIG. 7 is a plan view, in section, of the embodiment of the invention shown in FIG. 6.

When the first closure member 92 is removed from the interior chamber 80, the access opening 90 must still be covered over to enable the apparatus 52 to produce sound. The second closure member 110 is provided to cover over the access opening 90 when the first closure member 92 is not employed. The second closure member 110 has the same general configuration of the exterior wall 96 of the first closure member. The closure member 110 is dimensioned to provide a snug water tight fit inside the access opening 90 in the apparatus side wall 88. The member 102 is provided with a lip 112 that extends around the periphery of the member and engages in the shoulder 102 of the access opening 90 to seat the second closure member securely in the access opening. As shown in FIGS. 6 and 7, the second closure member 110 may be employed to selectively open and close the access opening 90 to permit the insertion or removal of a pea 114 in the interior chamber 80.

The embodiment of the invention shown in FIGS. 4–7 functions in substantially the identical manner as the embodiment of the invention shown in FIGS. 1–3, the exception being that the first and second closure members 92, 110 enable the sound generated by the apparatus 52 to be altered in the manner explained above.

Figure 8:
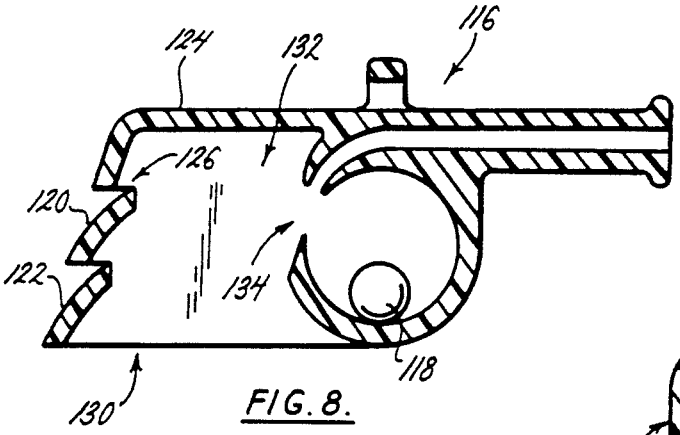
FIG. 8 is a side elevation view, in section, of a third embodiment of the invention.

FIG. 8 shows a still further embodiment of the apparatus of the invention. The all weather safety whistle and sound generator 116 shown in FIG. 8 is substantially identical to the embodiment of the invention shown in FIGS. 1-3 and explained above, the exception being that the embodiment of FIG. 8 is provided with a pea 118 and a pair of louvers 120, 122 in its cowling 124. The louvers 120, 122 permit sound generated by the apparatus 116 to exit through openings 126, 128 adjacent the louvers as well as the bottom opening 130 of the cowling. Simultaneously, the louvers 120, 122 prevent rain, wind or water from entering the interior volume 132 of the cowling 124 and obstructing the sound producing opening 134 of the apparatus when the apparatus is used in the orientation shown in FIG. 8.

Because the topmost louver opening 126 is positioned above the sound producing opening 134 of the FIG. 8 embodiment, this embodiment of the invention will not produce an air bubble beneath the cowling 124 sufficiently large to enable the invention to operate when completely submerged. Submerging the whistle 116 under water in the orientation shown in FIG. 8 will permit water to enter through the louver openings 126, 128 and obstruct the sound producing opening 134 of the whistle. This embodiment of the invention is best suited for operation in rainy conditions where the louvers 120, 122 will prevent rain from entering beneath the cowling 124 and the louver openings 126, 128 will permit sound produced by the whistle 116 to pass through the cowling.

Figure 9:
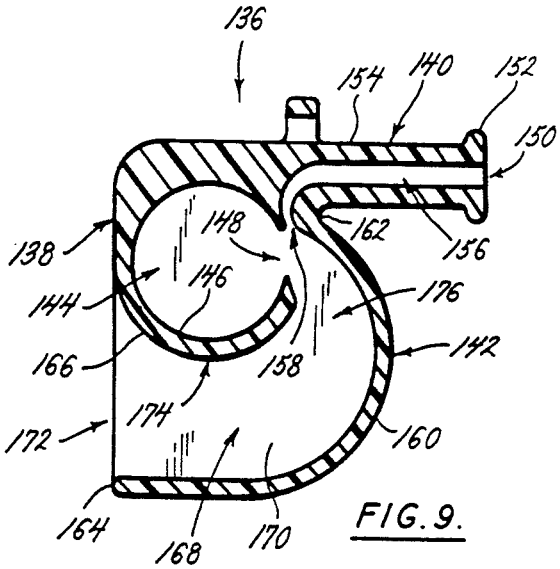
FIG. 9 is a side elevation view, in section, of a fourth embodiment of the invention.

FIG. 9 shows a still further embodiment of the all weather safety whistle and sound generator 136 of the present invention. The embodiment of FIG. 9 is also comprised of a body portion 138, a mouthpiece 140, and a cowling 142.

The body portion 138 contains an interior chamber 144 defined by a substantially cylindrical interior surface 146 of the chamber. A sound producing opening 148 is provided at one end of the body portion 138 communicating the interior volume of the chamber 144 with the exterior of the body portion.

The mouthpiece 140 is formed integrally with the body portion 138. The mouthpiece is provided with an air inlet opening 150 at one end and a ridge 152 formed on the exterior surface 154 of the mouthpiece surrounding the inlet opening. An air flow channel 156 extends through the mouthpiece from the inlet opening 150 to an air flow outlet 158 positioned adjacent the sound producing opening 148 of the body portion chamber 144. The mouthpiece 140 and body portion 138 function together to generate and emit sound from the sound producing opening 148 in much the same manner as the first embodiment of the invention. The embodiment of the invention shown in FIG. 9 differs primarily from the first embodiment of the invention in the positioning of the cowling 142 relative to the sound producing opening 148 and the body portion 138.

As seen in FIG. 9, the cowling 142 has a general semicircular shape. The cowling is comprised of a perimeter wall 160 having a first end 162 formed integrally with the mouthpiece 140 adjacent the air flow outlet 158 of the mouthpiece, and a second distal end 164 spaced below the exterior surface 166 of the body portion 138. Opposing side walls formed integrally with the apparatus body portion 138, mouthpiece 140, and cowling 142 cover over opposite sides of an interior volume 168 enclosed by the cowling perimeter wall 160. Only one of the side walls 170 is visible in FIG. 9.

The positioning of the cowling 142 in the embodiment of the apparatus 136 shown in FIG. 9 projects sound out of the cowling opening 172 in the same direction that the operator of the apparatus is facing. The general horn shape of the cowling interior 168 has a cross-sectional area that increases as it approaches the cowling opening 172 and serves to amplify the whistle sound as it passes through the cowling. The relative positions of the cowling 142 and the sound producing opening 148 of the apparatus enable the cowling 142 to shield the sound producing opening 148 against rain entering the opening while simultaneously enabling the projection of generated sound from the apparatus. Due to the curvature of the lower part of the body portion, the sound producing opening 148 is positioned above the cowling opening 172. This embodiment of the invention will also produce sound when completely submerged in the orientation shown in FIG. 9. When submerged, water will enter the interior of the cowling but will not rise above the lower end 174 of the body portion and approach the sound opening 148. An air bubble will form in the upper area 176 of the cowling interior and enable the whistle to function when submerged.

While the present invention has been described by reference to specific embodiments, it should be understood that modifications and variations of the invention may be constructed without departing from the scope of the invention defined in the following claims.

What is claimed is:

1. A sound generating apparatus for producing sound in response to air being blown through the apparatus, the apparatus comprising:

a mouthpiece having opposite first and second ends and an air flow channel extending through an interior of the mouthpiece between the first and second ends, and an air flow inlet provided at the first end of the mouthpiece to enable air to be blown into the inlet and through the air flow channel;

means connected with the mouthpiece for producing a sound in response to air being blown through the air flow channel of the mouthpiece, the means for producing a sound including a body portion having a hollow interior chamber and at least one body portion wall enclosing the interior chamber, the body portion wall being formed unitarily with the mouthpiece, the air flow channel extending through the body portion wall and opening into the interior chamber at the second end of the mouthpiece, and the body portion having a sound producing opening extending through the body portion wall from the interior chamber;

means connected with the sound producing means for forming and maintaining a bubble of air at the sound producing means when the apparatus is submerged under water, the air bubble maintained at the sound producing means enabling the sound producing means to produce sound in response to air being blow through the air flow channel of the mouthpiece when the apparatus is submerged under water, the means for forming and maintaining a bubble of air including a cowling having a hollow interior volume and at least one cowling wall enclosing the cowling interior volume, the cowling wall being formed unitarily with the body portion wall and enclosing the sound producing opening within the interior volume of the cowling, and the cowling wall having at least one sound emitting opening extending through the cowling wall from the interior volume of the cowling; and a second opening through the body portion wall to the interior chamber, and a closure member releasably attached to the body portion wall covering over the second opening, the closure member being removable from the body portion wall to open the second opening.

2. The apparatus of claim 1, wherein the closure member has an extension member on one side thereof, the extension member being inserted into the interior chamber when the closure member is attached to the body portion.

3. The apparatus of claim 2, wherein:

the extension member reduces an interior volume of the body portion interior chamber when the closure member is attached to the body portion.

* * * * *